US008381557B2

(12) United States Patent
Mak

(10) Patent No.: US 8,381,557 B2
(45) Date of Patent: Feb. 26, 2013

(54) MULTI-FUNCTIONAL COMBINATION GLASS DOOR HANDLE LOCK

(76) Inventor: Yun Sun Mak, Hong Kong (CN)

( * ) Notice: Subject to any disclaimer, the term of this patent is extended or adjusted under 35 U.S.C. 154(b) by 482 days.

(21) Appl. No.: 12/757,254

(22) Filed: Apr. 9, 2010

(65) Prior Publication Data

US 2010/0269554 A1 Oct. 28, 2010

(51) Int. Cl.
*E05B 47/00* (2006.01)

(52) U.S. Cl. ..... 70/277; 70/DIG. 31; 70/224; 70/452; 70/210; 292/336.3; 292/347; D8/300

(58) Field of Classification Search ..... 70/95, 210, 70/224, 451, 452, DIG. 31; D8/300, 302; 292/336.3, 347, 348, 350
See application file for complete search history.

(56) References Cited

U.S. PATENT DOCUMENTS 466,419 A * 1/1892 Kelley ..... 292/123
729,980 A * 6/1903 Vordemfelde ..... 292/29
1,662,773 A * 3/1928 Albach ..... 70/207
2,034,200 A * 3/1936 North ..... 70/207
2,082,195 A * 6/1937 Williams ..... 70/150
2,605,630 A * 8/1952 Keeler ..... 70/181
2,882,549 A * 4/1959 Strauss ..... 16/412
3,107,113 A * 10/1963 Sconzo ..... 292/228
3,353,855 A * 11/1967 Smith ..... 292/65
3,939,680 A * 2/1976 Heidkamp ..... 70/452
4,098,529 A * 7/1978 Bingham ..... 292/1
4,126,022 A * 11/1978 Bara Marco ..... 70/102
4,773,684 A * 9/1988 Dieckmann et al. ..... 292/357
5,092,144 A * 3/1992 Fleming et al. ..... 70/95
5,473,236 A * 12/1995 Frolov ..... 318/286
5,660,420 A * 8/1997 Smith et al. ..... 292/3
5,740,587 A * 4/1998 Onai et al. ..... 16/412
5,762,387 A * 6/1998 Edgerly et al. ..... 292/357
5,970,759 A * 10/1999 Trilk ..... 70/277
6,164,098 A * 12/2000 Hommes ..... 70/78
6,240,751 B1 * 6/2001 Marzolf et al. ..... 70/207
6,264,256 B1 * 7/2001 Hankel et al. ..... 292/336.3
6,449,994 B1 * 9/2002 Kreyenborg ..... 70/101
6,641,186 B2 * 11/2003 Tsai ..... 292/357
6,883,357 B1 * 4/2005 Cheng ..... 70/432
7,201,406 B2 * 4/2007 Walls et al. ..... 292/100
7,441,428 B2 * 10/2008 Chang et al. ..... 70/210
7,588,272 B2 * 9/2009 Gephart ..... 292/336.3
D629,275 S * 12/2010 Schmidt ..... D8/300
7,870,647 B2 * 1/2011 Steurer ..... 16/412
8,083,269 B2 * 12/2011 Mitchell ..... 292/52
8,215,731 B2 * 7/2012 Drach et al. ..... 312/405
2005/0104388 A1 * 5/2005 Takes ..... 292/336.3
2006/0184174 A1 * 8/2006 Harris et al. ..... 606/80
2010/0327612 A1 * 12/2010 Liebel et al. ..... 292/336.3

* cited by examiner

*Primary Examiner* — Suzanne Barrett
(74) *Attorney, Agent, or Firm* — Clement Cheng

(57) ABSTRACT

The invention comprises an adjustable door handle and an electronic or mechanical lock. The length of right outer handle, which is an adjustable handle and with cylindrical shape could be cut to suit for existing glass door holes. Its bottom should be put into a bottom cup of the right outer handle. The hole in center bottom of bottom cup should be put into a two-way screw of a cylindrical part of bottom piece and connect to a bottom piece of right outer handle. The bottom piece of the right outer handle has a bend body, its top end is a cylinder, and its middle body is a declining rectangular board, and lower end is a rectangular bend. The plane of the rectangular bend, right glass door and rectangular bend of the right door bottom piece will be connected and screw affixed.

16 Claims, 5 Drawing Sheets

MULTI-FUNCTIONAL COMBINATION GLASS DOOR HANDLE LOCK

This application claims priority from China application 200920055289.1 filed Apr. 24, 2009 having the same title and by same inventor, Yun Sun MAK, the disclosure of which is incorporated herein by reference.

FIELD OF THE INVENTION

The present invention is in the field of door locks.

DISCUSSION OF RELATED ART

Locks have traditionally been used for safekeeping property indoors. Presently, locks on houses are mostly mounted on wooden or metal doors such as steel doors. With lifestyle improvements, glass doors have become more popular at high image buildings, meeting rooms, reception rooms and other public places as a display of generosity and status. However, presently, locks are seldom used for glass door security. Other than locks, steel chains and mechanical locks are used to secure handles on glass doors. Even long mechanical locks such as the kind used on motorcycles have been used on glass door handles, which is inconvenient and so lacking in aesthetics that it makes the door out of harmony with an otherwise luxurious and elegant atmosphere. Therefore, many glass doors are not very suitable for installation of locks.

The present invention provides a multifunction combined glass door handle lock which can be installed on regular tempered glass door, or traditional door such as a wood or metal door. The lock is comprised of two parts namely handle and lock, which includes a handle as well as a lock body that can be installed not only on a regular glass door but also on a tempered glass door. The lock could be installed on a newly installed as well as old or used glass door, and a combination wood and metal door, as well as a single door or double-leaf door. This multifunctional invention could solve many existing technical problems regarding glass door lock mounting.

Several technical problems regarding typical glass door lock installations lie in the following aspects. First of all, with the features of hardness and fragileness, glass and especially tempered glass is difficult to drill with regular tools, such that a lock cannot be installed and fixed in the glass door by wood screws. Wood screws could be used to fix locks when installing on wood doors, however not for glass doors. Locks could be welded on metal or metal doors as well as installed and fixed by electronic drill and screws, however, a hand drill cannot be used on regular glass. Normally, regular glass should be drilled in glass factory with particular equipment, and after that if regular glass is made into tempered glass, it would not be drilled again. When regular glass is drilled accordingly in a glass factory and is then made into tempered glass, then if there is any error in size or installation position, this would amount to waste. Also, most wood or metal doors are single-leaf, and the lockbody can be installed on board of wood or metal door, while the striking plate box is fixed in the fixed wooden or metal door frame.

When locking the door, the bolt of the lock body would obtain access to the striking hole of striking plate box for security. If the striking plate box is fixed in a wooden or metal door frame, the latch bolt could be easily locked into the box and generally the length of bolt is about 10 mm. On the other hand, glass doors are often double-leaf, which comprise two boards. If the length of a bolt is too short, the door could still be pushed open. Therefore, existing latch bolt structures may not suitable for a glass door having a double-leaf construction.

SUMMARY OF THE INVENTION

The present invention adopts the following configuration. The present invention uses a combination structure, which is includes a handle and lock. The adjustable handle replaces the current fixed handle, and makes glass door handles installable not only on regular and tempered glass doors, but also on new installed and used glass doors. Whatever the glass door configuration, if the door handle is in standard size, a general length handle can be used to replace a previous handle and install the lock on the handle. A cannular screw in the axis center connects the outer lock body to the inner lock body and the line of electrical locks. The glass clamp is position adjustable. A rectangular bolt is installed to solve the problem that length of latch bolt is not suitable for glass doors with double-leaf. Multi-function options can be installed such as code, RF and IC card, mechanical, or combination of electronic and mechanical applied to make the lock be installed on door with single or double-leaf, wooden or metal material.

The handle could be described as a left or right handed handle depending upon user orientation. Specifically, the first embodiment of the invention is comprised of two parts, namely an adjustable door handle and an electronic lock and/or mechanical lock. The length of right outer handle, which is an adjustable handle and with cylindrical shape could be cut to suit for existing glass door holes. Its bottom should be put into a bottom cup of the right outer handle. The hole in center bottom of bottom cup should be put into a two-way screw of a cylindrical part of bottom piece and connect to a bottom piece of right outer handle. The bottom piece of the right outer handle has a bend body, its top end is a cylinder, and its middle body is a declining rectangular board, and lower end is a rectangular bend. The plane of the rectangular bend, right glass door and rectangular bend of the right door bottom piece will be connected and screw affixed.

The upper part of the right outer handle should be put into the upper cup. The hole in the center bottom of upper cup should be put into a two-way screw of a cylindrical part of an upper piece and connected to an upper piece of a right outer handle. The shape and structure of a right outer handle upper piece are the same as the bottom piece, the only difference lies in the thickness, which means the thickness of bottom rectangular bend is half that of bottom piece of rectangular bow in order to maintain the straightness of the outer handle. The rectangular bend of the upper piece, lower part of the metal plate having a rectangular shape at right outer door, and rectangular bend of the upper piece at the right outer handle should be connected and fixed with a screw. Metal plate of the outer right door is fixed to install on outer lockbody of electronic code lock and/or mechanical lock, and connector of electronic code lock and/or mechanical lock, and knob. The cannular screw with a hole in the center of axis will span across the hole of the right inner metal plate which with a rectangular shape is behind the right glass door, and the glass door so as to connect to the screw hole of the right outer metal plate. The shape and measurement of the right inner metal plate is the same as the right outer metal plate.

The lockbody connector is connected to outside lockbody of electronic and/or mechanical lock and electronic lock wiring passes via the center hole of the cannular screw, which provides interconnection between the rectangular shaped latch of the inside lockbody which is fixed inside the metal plate of the right door. Furthermore, a thief-proof knob connects the lockbody connector to latch outside the inner lockbody.

The inner lockbody is fixed to the upper part of the inner metal plate on the right door with the screw. The bottom part of the inner plate at the right door is connected to the rectangular bend of the upper piece of the right inner handle with a screw. The size and structure of the right inner upper piece is the same as upper piece of the right outside handle. The hole in the center bottom part of the bottom cup should be put into a two-way screw of the cylindrical part of upper piece and connected to the upper piece of the right inner handle. The measurement of right inner handle and right outer handle also can be cut to corresponding size of existing hole, its upper part and bottom part separately put into the upper cup and the bottom cup of the right inner handle. Meanwhile, the bottom cup could be connected to the bottom piece of the right inner handle, and the rectangular bend part, the right glass door and the inside of the right door bottom piece will be connected and fixed with a screw. There is a glass slot and latch hole in latch cover. The glass slot is installed beside left glass door so that the position could be adjusted while installing, and the latch cover only needs to be fixed in the left glass door with a screw.

Cylindrical inner and outer handles on a right door can be interchangeable if the shape, structure and measurement are similar. The shaped and internal structure of the inner bottom piece, the inner upper piece, the outer upper piece and the outer bottom piece are preferably the same. The shape, internal structure and measurement of the inner bottom cup, the inner upper cup, the outer upper cup and the outer bottom cup are also preferably similar such that they can be interchangeable.

A set of expansion and compression internal structures inside the handle may provide links adjustability for the handle. The expansion and compression internal structures may include an inside outer bottom cup, outer upper cup, inner upper cup and inner bottom cup respectively, and may allow connection between outer handle and outer bottom piece and outer upper piece, inner handle connect to the inner upper piece and the inner bottom piece of a right door. The above expansion compression internal structure comprises a two-way screw installed and a fixed in the center of the cylinder axis part of the bottom piece to put the hole in the center bottom part of the bottom cup into the two-way screw and connect it to bottom piece. The expansion compression internal structure is also comprised of a round tray which with a hole in a bottom center and whose outside diameter is less than inside diameter of cylinder handle. Also, an 0 style rubber ring B, a round metal ring, an 0 style rubber ring A and a cylindrical nut are put into the round tray one by one. The internal thread of cylindrical nut is connected to cylindrical two-way screw of the bottom piece. The expansion compression internal structures may further have air seal or pressurized air seal at the interface between the hollow handle and cylindrical nut.

A mechanical lock and/or electronic lock as mentioned above, could include functions such as electronic code, RF, IC, mechanical, or combination of electronic and mechanical methods. A cannular screw is a screw that has a central canal. The central canal can pass through a central axis of the screw. The central canal have a smooth surface. A junction includes a cup or a joining face. An actuation means such as a wire passing through the canal or a mechanical linkage can provide actuation from a knob to the latch, or from a lock to a latch.

The second embodiment of the invention generally comprises two parts: namely a fixed-length handle and an electronic or mechanical lock. The right outer handle with a fixed-length is bow shaped. The lock bottom plane right glass door and rectangular bend of right inner handle bottom part are connected with a screw. The upper part of the right outer handle is connected and fixed to the bottom part of the right outer metal plate with a screw. The structure and installation of above mentioned electronic and/or mechanical lock are analogous to the adjustable handle. The shape and size of the right inner handle are the same as the right outer handle. The upper part is connected to bottom part of the right inner metal plate and affixed with a screw. A rectangular bend of the right inner handle bottom part, right glass door, and rectangular bend of right outer handle bottom part are connected and fixed with a screw.

Figure 1:
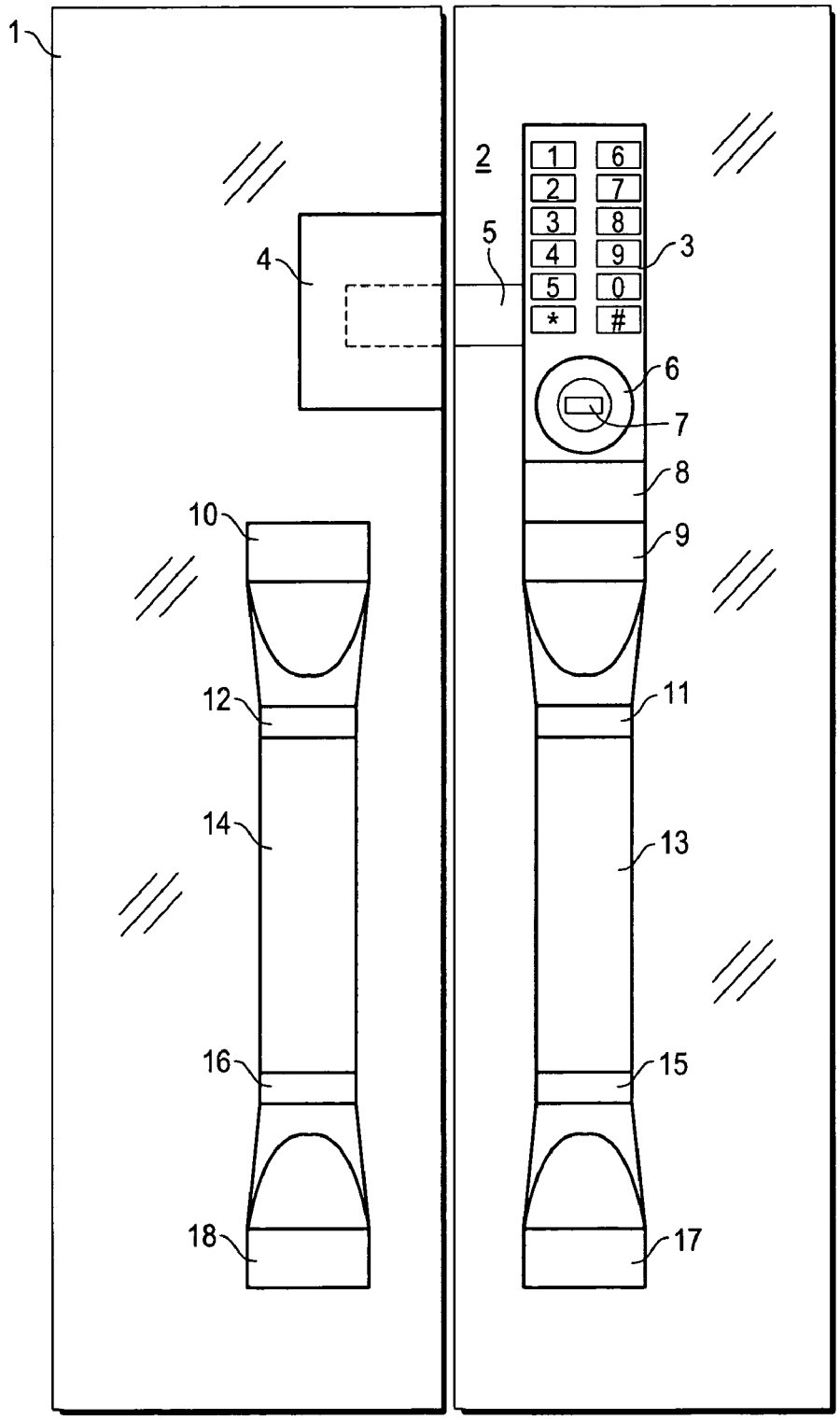
FIG. 1 is a main view of the adjustable door handle lock.
Figure 2:
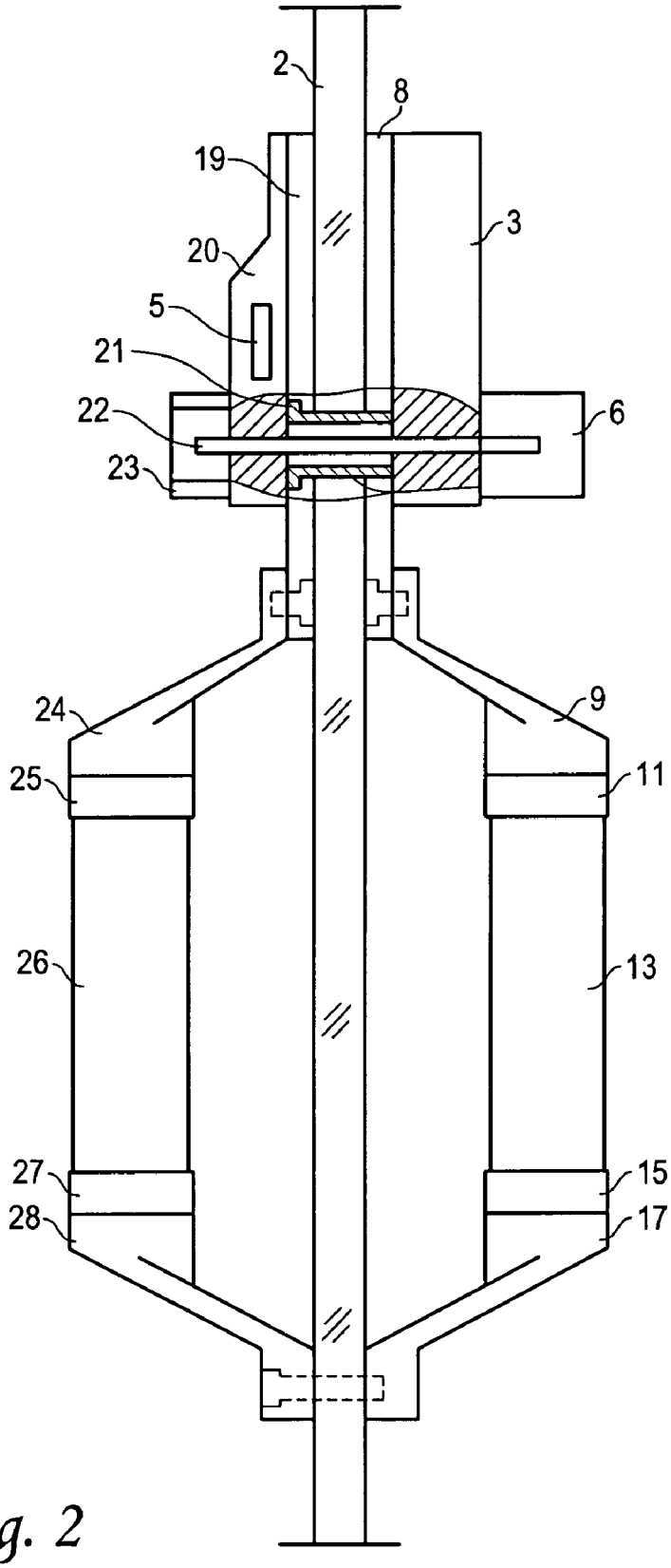
FIG. 2 is left view of installation diagram for the right glass door in FIG. 1.
Figure 3:
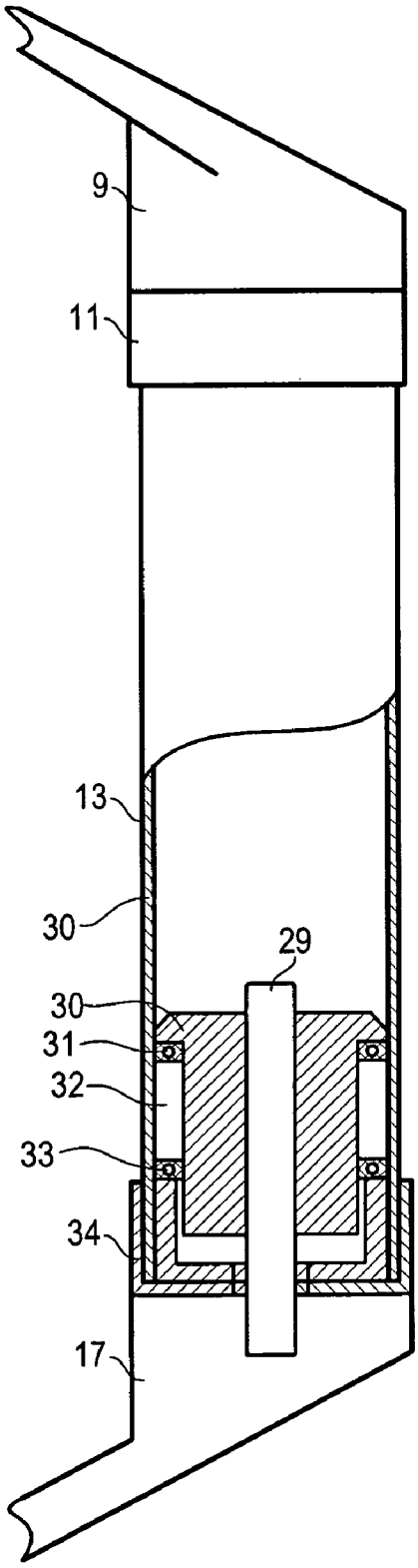
FIG. 3 is partial sectional view of the right outer handle.

The following callout list of elements can be used for referencing the elements of the drawings:

1. Left Glass Door
2. Right Glass Door
3. Outer Lockbody Of Electronic Code Lock
4. Bolt Cover
5. Bolt
6. Knob
7. Mechanical Lock
8. Outer Metal Plate Of Right Handle
9. Outer Upper Piece Of Right Handle
10. Outer Upper Piece Of Left Handle
11. Outer Upper Cup Of Right Handle
12. Outer Upper Cup Of Left Handle
13. Outer Handle Of Right Door
14. Outer Handle Of Left Door
15. Outer Bottom Cup Of Right Handle
16. Outer Bottom Cup Of Left Handle
17. Outer Bottom Piece Of Right Handle
18. Outer Bottom Piece Of Left Handle
19. Inner Plate Of Right Door
20. Inner Lock Body
21. Hollow Screw
22. Connector Of Lockbody
23. Theft-Proof Knob
24. Inner Upper Piece Of Right Handle
25. Inner Upper Cup Of Right Handle
26. Inner Handle Of Right Door
27. Inner Bottom Cup Of Right Handle
28. Inner Bottom Piece Of Right Handle
29. Two-Way Screw
30. Nut
31. O Style Rubber Ring A
32. Metal Ring
33. O Style Rubber Ring B
34. Round Tray
35. Glass Slot
36. Bolt Hole
37. Screw
38. Inner Handle Of Right Door
39. Outer Handle Of Right Door

DETAILED DESCRIPTION OF THE PREFERRED EMBODIMENT

The first embodiment of an adjustable door handle lock relates to FIGS. 1, 2, 3, 5, 6, 7, 8. The first embodiment, comprises two parts, namely the adjustable door handle and the electronic lock and/or mechanical lock. The length of right outer handle (13), which is in the adjustable handle and has cylindrical shape, could be cut to suit existing glass door holes. Its bottom should be put into bottom cup (15) of the right outer handle. The hole in the center bottom of bottom cup (15) should connect to bottom piece (17) of right outer handle; bottom piece (17) of right outer handle has a bend body, its up end is cylindrical, middle body is a declining rectangular board, lower end is rectangular bend. The plane of rectangular bend, right glass door (2) and rectangular bend of right door bottom piece (28) will be connected and fixed with a screw.

The upper part of the right outer handle (13) should be put into upper cup (11). The hole in the center bottom of upper cup (11) should be put into the two-way screw of the cylindrical part of the upper piece (9) and connect to the upper piece (9) of the right outer handle. The shaped and structure of the right outer handle upper piece (9) is the same as the bottom piece (17). The rectangular bend of the upper piece (9), the lower part of metal plate (8) having a rectangular shape at the right outer door, and the rectangular bend of the upper piece (9) at the right outer handle should be connected and screw affixed.

The cannular screw (21) with a hole in the center of axis will span across the hole of the right inner metal plate (19) which with a rectangular shape behind the right glass door (2), and the glass door (2) so as to connect to the screw hole of the right outer metal plate (8). The shape and measurement of the right inner metal plate (19) is the same as the right outer metal plate (8).

The lockbody connector (22) is connected to outside lockbody (3) of electronic and/or mechanical lock and electronic lock wiring passes via the center hole of the cannular screw (21), which provides interconnection between the rectangular shaped latch (5) of the inside lockbody (20) which is fixed inside the metal plate of the right door. Furthermore, a thiefproof knob (23) connects the lockbody connector (22) to latch (5) outside the inner lockbody (20).

The inner lockbody is fixed to the upper part of the inner metal plate on the right door with the screw. The bottom part of the inner plate (19) at the right door is connected to the rectangular bend of the upper piece (24) of the right inner handle with a screw. The size and structure of the right inner upper piece (24) is the same as upper piece of the right outside handle. The hole in the center bottom part of the upper cup (25) should be put into a two-way screw of the cylindrical part of upper piece (24) and connected to the upper piece (24) of the right inner handle. The measurement of right inner handle (26) and right outer handle (13) also can be cut to corresponding size of existing hole, its upper part and bottom part separately put into the upper cup (25) and the bottom cup (27) of the right inner handle. Meanwhile, the bottom cup (27) could be connected to the bottom piece (28) of the right inner handle, and the rectangular bend part, the right glass door (2) and the inside of the right door bottom piece (17) will be connected and fixed with a screw. There is a glass slot (35) and latch hole (36) in latch cover (4). The glass slot is installed beside left glass door (1) so that the position could be adjusted while installing, and the latch cover (4) only needs to be fixed in the left glass door (1) with a screw.

With the features of a rectangle shape and longer size, the bolt can lock the double-leaf glass door as well.

Figure 4:
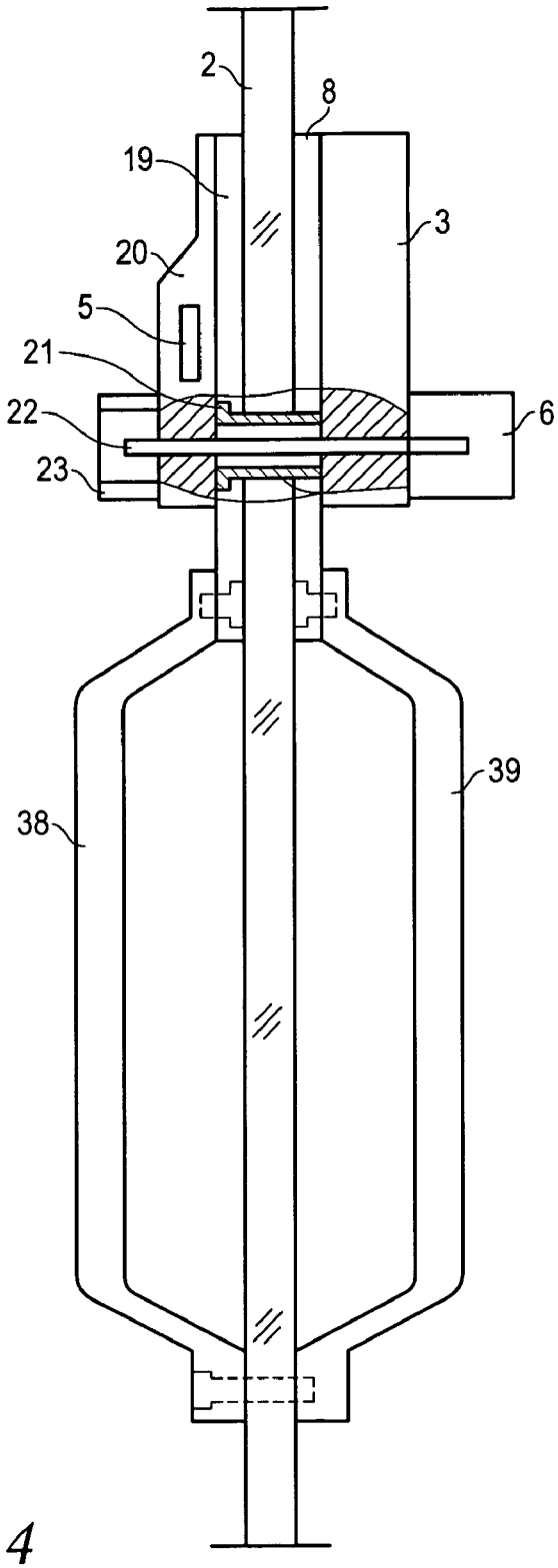
FIG. 4 is installation diagram of the fixed length door handle lock.
Figure 5:
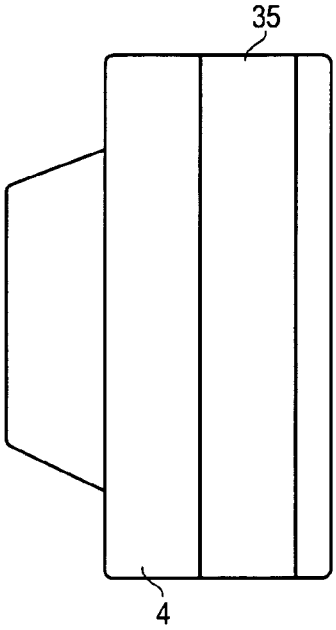
FIG. 5 is left view of the bolt cover.
Figure 6:
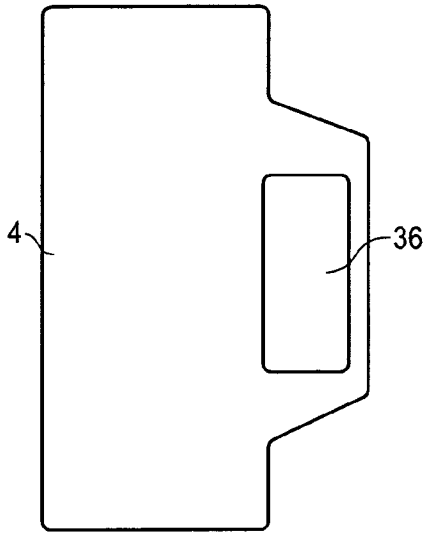
FIG. 6 is right view of the bolt cover.
Figure 7:
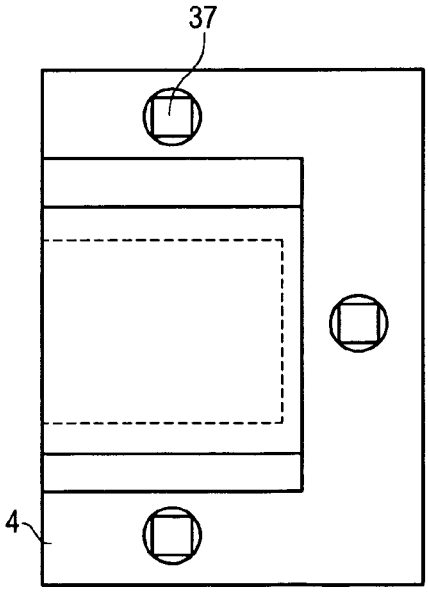
FIG. 7 is back view of the bolt cover.
Figure 8:
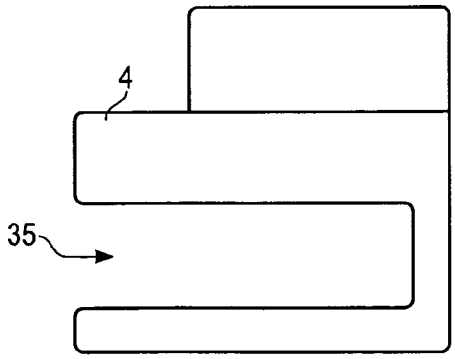
FIG. 8 is top view of the bolt cover.

The second embodiment of the fixed length glass door handle lock is directed to FIG. 4 which is an example of the second embodiment. The second embodiment differs from the first embodiment in that it has a fixed length, although the electronic lock and installation procedures are exactly the same.

The second embodiment of the invention generally comprises two parts: namely a fixed-length handle and an electronic or mechanical lock. The outer handle can be bow shaped and flat having bends. The right outer handle (39) with a fixed-length is bow shaped. The lock bottom plane right glass door (2) and rectangular bend of right inner handle (38) bottom part are connected with a screw. The upper part of the right outer handle (39) is connected and fixed to the bottom part of the right outer metal plate (8) with a screw. The structure and installation of above mentioned electronic and/or mechanical lock are analogous to the adjustable handle. The shape and size of the right inner handle (38) are the same as the right outer handle (39). The upper part is connected to bottom part of the right inner metal plate (19) and affixed with a screw. A rectangular bend of the right inner handle (38) bottom part, right glass door (2), and rectangular bend of right outer handle (39) bottom part are connected and fixed with a screw.

A mechanical lock and/or electronic lock as mentioned above, could include functions such as electronic code, RF, IC, mechanical, or combination of electronic and mechanical methods. The lock may have an electronic code, RF or IC function. A cannular screw is a screw that has a central canal. The central canal can pass through a central axis of the screw. The central canal have a smooth surface. A junction includes a cup or a joining face. An actuation means such as a wire passing through the canal or a mechanical linkage can provide actuation from a knob to the latch, or from a lock to a bolt.

The invention claimed is:

1. A multifunction combination door handle lock comprising:

a. a lock, wherein the lock is electronic or mechanical;

b. an adjustable door handle comprising:

i. an outer handle;

ii. an outer top junction;

iii. an outer bottom junction;

iv. an inner top junction;

v. an inner bottom junction and an inner handle connected between the inner top junction and the inner bottom junction;

vi. wherein the outer handle has an outer top end and an outer bottom end, wherein the outer top end is received in the outer top junction and the outer bottom end is received into the outer bottom junction;

vii. a hole in the outer bottom junction;

viii. wherein the outer bottom junction has an outer bottom junction upper end and further comprising a middle body, and wherein an outer bottom junction lower end has a bend, wherein the bend is connected by a connector screw;

c. a door, wherein the connector screw makes connection between the inner bottom junction and the outer bottom junction;

d. wherein the outer door metal plate is installed with the lock over the outer door metal plate, wherein the lock further comprises a knob; and e. a cannular screw having a canal along a central axis crossing through the door and through an inner metal plate having an inner metal plate screw hole and wherein the cannular screw passes through an outer metal plate, wherein the outer metal plate has an outer metal plate screw hole, wherein the cannular screw passes through the outer metal plate screw hole;

f. wherein the inner handle is cylindrical, wherein the inner top junction forms an inner top cup, wherein the inner bottom junction forms an inner bottom cup.

2. The multifunction combination door handle lock of claim 1, wherein the lock has an electronic code, RF or IC function.

3. The multifunction combination door handle lock of claim 1, wherein the outer handle is bow shaped and flat having bends.

4. The multifunction combination door handle lock of claim 1, further comprising:

a. an actuation means passing through the canal of the cannular screw from the lock to a knob, wherein the actuation means actuate a bolt, when a user uses the lock.

5. A multifunction combination door handle lock comprising:

a. a lock, wherein the lock is electronic or mechanical;

b. an adjustable door handle comprising:

i. an outer handle;

ii. an outer top junction;

iii. an outer bottom junction;

iv. an inner top junction;

v. an inner bottom junction and an inner handle connected between the inner top junction and the inner bottom junction;

vi. wherein the outer handle has an outer top end and an outer bottom end, wherein the outer top end is received in the outer top junction and the outer bottom end is received into the outer bottom junction;

vii. a hole in the outer bottom junction;

viii. wherein the outer bottom junction has an outer bottom junction upper end and further comprising a middle body, and wherein an outer bottom junction lower end has a bend, wherein the bend is connected by a connector screw;

c. a door, wherein the connector screw makes connection between the inner bottom junction and the outer bottom junction;

d. wherein the outer door metal plate is installed with the lock over the outer door metal plate, wherein the lock further comprises a knob; and e. a cannular screw having a canal along a central axis crossing through the door and through an inner metal plate having an inner metal plate screw hole and wherein the cannular screw passes through an outer metal plate, wherein the outer metal plate has an outer metal plate screw hole, wherein the cannular screw passes through the outer metal plate screw hole;

f. wherein the inner handle and the outer handle are mechanically interchangeable, wherein the outer handle is cylindrical, wherein the outer top junction forms an outer top cup, wherein the outer bottom junction forms an outer bottom cup, wherein the inner handle is cylindrical, wherein the inner top junction forms an inner top cup, wherein the inner bottom junction forms an inner bottom cup, wherein the outer top junction is mechanically interchangeable with the inner top junction, wherein the outer bottom junction is mechanically interchangeable with the inner bottom junction.

6. The multifunction combination door handle lock of claim 5, further comprising:

a. an actuation means passing through the canal of the cannular screw from the lock to a knob, wherein the actuation means actuate a bolt, when a user uses the lock.

7. The multifunction combination door handle lock of claim 5, wherein the lock has an electronic code, RF or IC function.

8. The multifunction combination door handle lock of claim 5, wherein the outer handle is bow shaped and flat having bends.

9. A multifunction combination door handle lock comprising:

a. a lock, wherein the lock is electronic or mechanical;

b. an adjustable door handle comprising:

i. an outer handle;

ii. an outer top junction;

iii. an outer bottom junction;

iv. an inner top junction;

v. an inner bottom junction and an inner handle connected between the inner top junction and the inner bottom junction;

vi. wherein the outer handle has an outer top end and an outer bottom end, wherein the outer top end is received in the outer top junction and the outer bottom end is received into the outer bottom junction;

vii. a hole in the outer bottom junction;

viii. wherein the outer bottom junction has an outer bottom junction upper end and further comprising a middle body, and wherein an outer bottom junction lower end has a bend, wherein the bend is connected by a connector screw;

c. a door, wherein the connector screw makes connection between the inner bottom junction and the outer bottom junction;

d. wherein the outer door metal plate is installed with the lock over the outer door metal plate, wherein the lock further comprises a knob; and e. a cannular screw having a canal along a central axis crossing through the door and through an inner metal plate having an inner metal plate screw hole and wherein the cannular screw passes through an outer metal plate, wherein the outer metal plate has an outer metal plate screw hole, wherein the cannular screw passes through the outer metal plate screw hole;

f. wherein the outer handle further comprises an expansion compression internal structure.

10. The multifunction combination door handle lock of claim 9, a. wherein the outer handle further comprises an expansion compression internal structure; and wherein the outer handle is cylindrical, wherein the outer top junction forms an outer top cup, wherein the outer bottom junction forms an outer bottom cup; and wherein the inner handle is cylindrical, wherein the outer top junction forms an inner top cup, wherein the inner bottom junction forms an inner bottom cup; wherein the expansion compression internal structure expands, with a two-way screw installed and fixed in a center of a cylinder axis part of the outer bottom junction, wherein the two-way screw extends into an aperture in a center bottom part of the outer bottom cup, further comprising a pair of O ring ceiling sealing an interface between a cylindrical nut and the outer handle.

11. The multifunction combination door handle lock of claim 9, further comprising:

a. an actuation means passing through the canal of the cannular screw from the lock to a knob, wherein the actuation means actuate a bolt, when a user uses the lock.

12. The multifunction combination door handle lock of claim 9, wherein the lock has an electronic code, RF or IC function.

13. The multifunction combination door handle lock of claim 9, wherein the outer handle is bow shaped and flat having bends.

14. The multifunction combination door handle lock of claim 10, further comprising:

a. an actuation means passing through the canal of the cannular screw from the lock to a knob, wherein the actuation means actuate a bolt, when a user uses the lock.

15. The multifunction combination door handle lock of claim 10, wherein the lock has an electronic code, RF or IC function.

16. The multifunction combination door handle lock of claim 10, wherein the outer handle is bow shaped and flat having bends.

* * * * *